US008678140B2

(12) United States Patent
Gieras et al.

(10) Patent No.: US 8,678,140 B2
(45) Date of Patent: Mar. 25, 2014

(54) ELECTROMAGNET AND ELEVATOR DOOR COUPLER

(75) Inventors: Jacek F. Gieras, Glastonbury, CT (US); Sastry V. Vedula, Glastonbury, CT (US); Pei-Yuan Peng, Manchester, CT (US); Bryan Robert Siewert, Westbrook, CT (US)

(73) Assignee: Otis Elevator Company, Farmington, CT (US)

( * ) Notice: Subject to any disclaimer, the term of this patent is extended or adjusted under 35 U.S.C. 154(b) by 813 days.

(21) Appl. No.: 12/088,863

(22) PCT Filed: Oct. 11, 2005

(86) PCT No.: PCT/US2005/036584

§ 371 (c)(1),
(2), (4) Date: Apr. 1, 2008

(87) PCT Pub. No.: WO2007/044008

PCT Pub. Date: Apr. 19, 2007

(65) Prior Publication Data

US 2008/0257653 A1 Oct. 23, 2008

(51) Int. Cl.
*B66B 13/06* (2006.01)
*B66B 13/12* (2006.01)
*H01F 3/00* (2006.01)

(52) U.S. Cl.
USPC ..... 187/325; 187/330; 187/319; 335/279

(58) Field of Classification Search
USPC ..... 187/313–335; 335/279, 281, 282
See application file for complete search history.

(56) References Cited

U.S. PATENT DOCUMENTS

| | | | | | |
|---|---|---|---|---|---|
| 1,344,430 | A | * | 6/1920 | Wigmore et al. | 187/331 |
| 2,858,904 | A | * | 11/1958 | Heart | 187/316 |
| 4,491,816 | A | * | 1/1985 | Blum | 335/245 |
| 4,554,938 | A | | 11/1985 | Twisselmann | |
| 4,638,279 | A | * | 1/1987 | Brisson et al. | 335/257 |
| 4,700,165 | A | * | 10/1987 | Brisson et al. | 335/255 |
| 5,487,449 | A | | 1/1996 | Barrett et al. | |
| 5,646,588 | A | * | 7/1997 | Cannon | 335/281 |

(Continued)

FOREIGN PATENT DOCUMENTS

| | | | |
|---|---|---|---|
| JP | 5041340 | | 4/1975 |
| JP | 54-47256 | * | 4/1979 |
| JP | 10-36046 | * | 2/1998 |

OTHER PUBLICATIONS

International Search Report and Written Opinion of the International Searching Authority for International application No. PCT/US05/36584 mailed Feb. 5, 2007.

(Continued)

*Primary Examiner* — William E Dondero
*Assistant Examiner* — Minh Truong
(74) *Attorney, Agent, or Firm* — Carlson, Gaskey & Olds

(57) ABSTRACT

An elevator door assembly (20) includes an electromagnet (30) use as part of a door coupler for coupling elevator car doors (24) to elevator hoistway doors (26). A disclosed example includes an electromagnet core (40) with a gap (50) in one of four sides of the core. The gap (50) directs and concentrates magnetic flux of the electromagnet (30) to concentrate an attractive force for coupling the electromagnet (30) with a vane (32). Disclosed examples includes unique geometric and dimensional relationships to achieve a desired goodness factor.

25 Claims, 2 Drawing Sheets

(56) References Cited

U.S. PATENT DOCUMENTS 5,808,537 A * 9/1998 Kondo et al. ..... 336/233
6,070,700 A 6/2000 Nagel
6,472,968 B1 * 10/2002 Ohya ..... 335/229
6,642,825 B2 * 11/2003 Ohya ..... 335/229

OTHER PUBLICATIONS

Extended European Search Report for Application No. EP 05 81 0415 dated Jun. 24, 2011.

* cited by examiner

ELECTROMAGNET AND ELEVATOR DOOR COUPLER

FIELD OF THE INVENTION

This invention generally relates to electromagnets. More particularly, this invention relates to an electromagnet useful in a door coupler arrangement for elevator systems.

DESCRIPTION OF THE RELATED ART

Elevators typically include a car that moves vertically through a hoistway between different levels of a building. At each level or landing, a set of hoistway doors are arranged to close off the hoistway when the elevator car is not at that landing. The hoistway doors open with doors on the car to allow access to or from the elevator car when it is at the landing. It is necessary to have the hoistway doors coupled appropriately with the car doors to open or close them.

Conventional arrangements include a door interlock that typically integrates several functions into a single device. The interlocks lock the hoistway doors, sense that the hoistway doors are locked and couple the hoistway doors to the car doors for opening purposes. While such integration of multiple functions provides lower material costs, there are significant design challenges presented by conventional arrangements. For example, the locking and sensing functions must be precise to satisfy codes. The coupling function, on the other hand, requires a significant amount of tolerance to accommodate variations in the position of the car doors relative to the hoistway doors. While these functions are typically integrated into a single device, their design implications are usually competing with each other.

Conventional door couplers include a vane on the car door and a pair of rollers on a hoistway door. The vane must be received between the rollers so that the hoistway door moves with the car door in two opposing directions (i.e., opening and closing). Common problems associated with such conventional arrangements is that the alignment between the car door vane and the hoistway door rollers must be precisely controlled. This introduces labor and expense during the installation process. Further, any future misalignment results in maintenance requests or call backs.

It is believed that elevator door system components account for approximately 50% of elevator maintenance requests and 30% of callbacks. Almost half of the callbacks due to a door system malfunction are related to one of the interlock functions.

There is a need in the industry for an improved arrangement that provides a reliable coupling between the car doors and hoistway doors, yet avoids the complexities of conventional arrangements and provides a more reliable arrangement that has reduced need for maintenance.

Any new elevator door coupler design must fit within the tight space constraints mandated by codes. For example, an elevator door coupler arrangement must leave a 6.5 mm minimum clearance between the car door sill and the coupler components on a hoistway door. At the same time a 6.5 mm minimum clearance must be maintained between the hoistway door sill and the coupler components on the car. The total gap between a typical car door sill and a typical hoistway door sill is about 25 mm (one inch). Such space constraints place limitations on the type of components that can be used as an elevator door coupler. Therefore, strategic arrangement of parts becomes necessary to implement new coupling techniques.

This invention provides a unique electromagnet design that is suitable for use in an elevator door coupler that avoids the shortcomings and drawbacks of previous devices.

SUMMARY OF THE INVENTION

An exemplary disclosed embodiment of an elevator door assembly includes an electromagnet associated with a first elevator door. The electromagnet includes a core that has first and second sides aligned at least partially generally parallel to each other. Third and fourth sides are aligned at least partially generally parallel to each other and at least partially generally perpendicular to the first and second sides. The first, second and third sides are uninterrupted while the fourth side includes a gap. A size of the gap is smaller than a spacing between the first and second sides. A vane is associated with a second elevator door and positioned near the gap in the fourth side of the electromagnet when the first and second elevator doors are appropriately aligned with each other. A magnetic coupling between the electromagnet and the vane facilitate the first and second elevator doors moving together. The gap in the core of the electromagnet facilitates directing the attractive magnetic force of the electromagnet in a manner that enhances a coupling with the vane.

In one example, the electromagnet is thermally coupled with a door hanger of the first elevator door such that the door hanger acts as a heat sink for the electromagnet.

The various features and advantages of this invention will become apparent to those skilled in the art from the following detailed description of the currently preferred embodiment. The drawings that accompany the detailed description can be briefly described as follows.

DETAILED DESCRIPTION OF A PREFERRED EMBODIMENT

Figure 1:
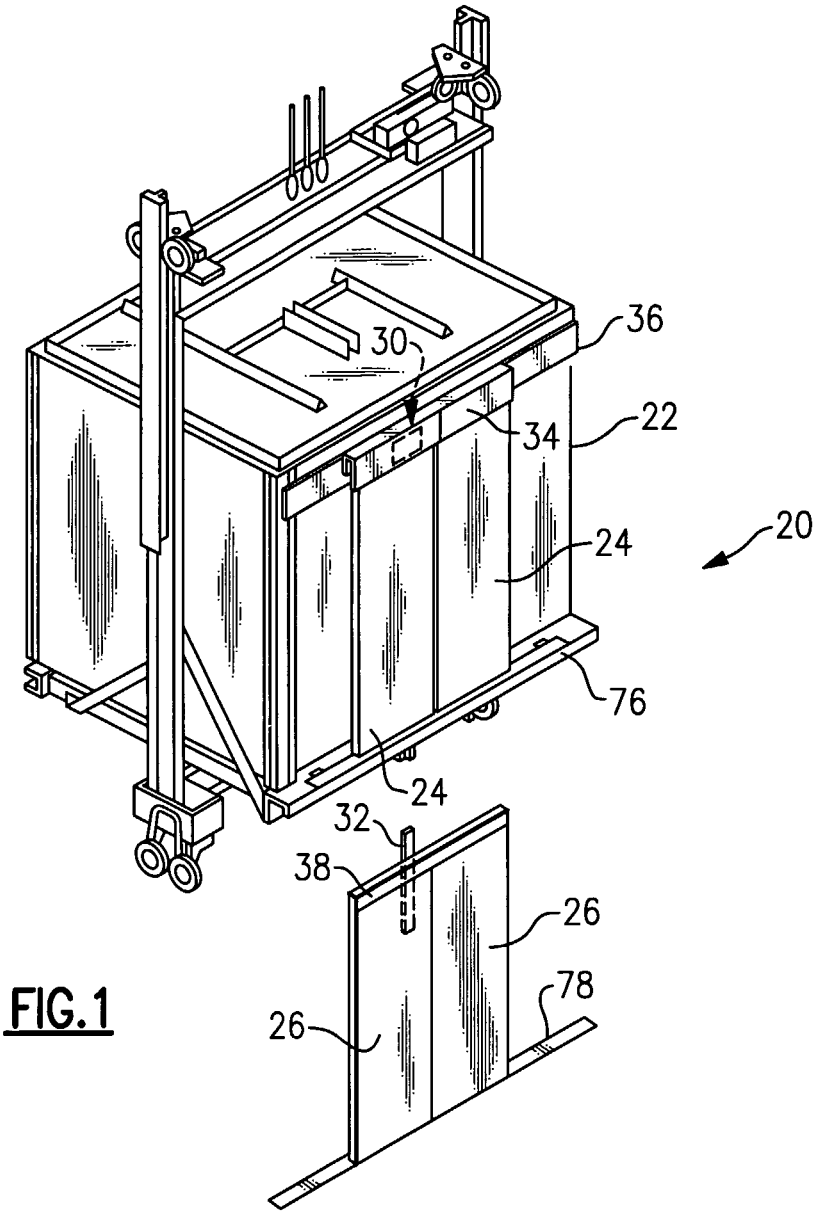
FIG. 1 schematically illustrates selected portions of an elevator system incorporating a door assembly designed according to an embodiment of this invention.

FIG. 1 schematically shows an elevator door assembly 20 that includes a unique door coupler. An elevator car 22 has car doors 24 that are supported for movement with the car through a hoistway, for example. The car doors 24 become aligned with hoistway doors 26 at a landing, for example, when the car 22 reaches an appropriate vertical position.

The illustrated example includes a door coupler to facilitate moving the car doors 24 and the hoistway doors 26 in unison when the car 22 is appropriately positioned at a landing. In this example, the door coupler includes an electromagnet 30 associated with at least one of the car doors 24. At least one of the hoistway doors 26 has an associated vane 32 that cooperates with the electromagnet 30 to keep the doors 26 moving in unison with the doors 24 as desired.

In the illustrated example, the electromagnet 30 is supported on a door hanger 34 that cooperates with a track 36 in a known manner for supporting the weight of an associated door and facilitating movement of the door. The vane 32 in this example is supported on a hoistway door hanger 38.

Given the tight dimensional constraints on elevator door coupler arrangements, the illustrated example includes a unique electromagnet design that concentrates the attractive, magnetic force for coupling the electromagnet 30 with the vane 38 so that the elevator doors 24 and 26 are appropriately coupled together.

Figure 2:
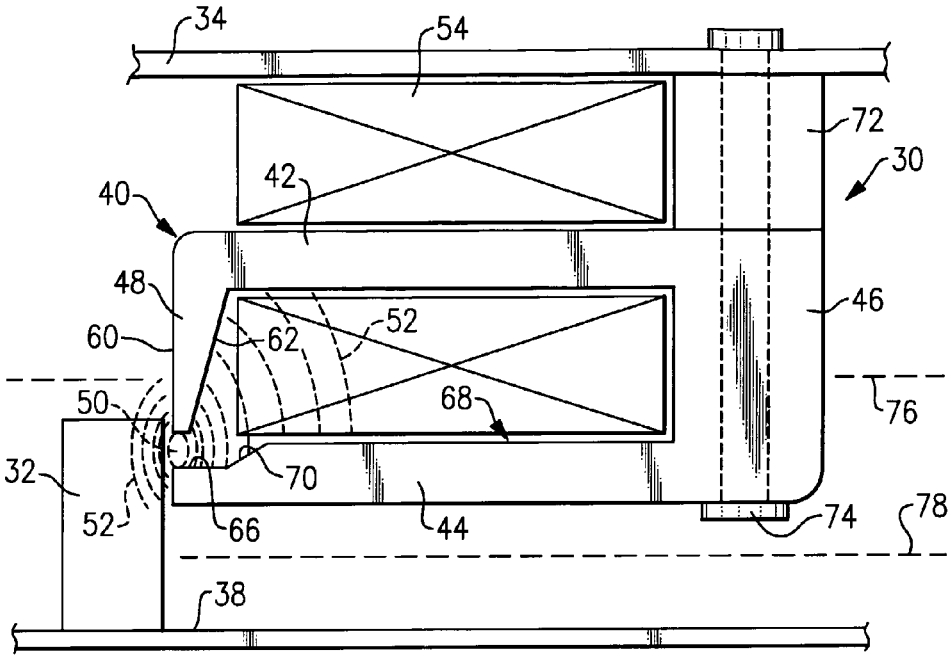
FIG. 2 schematically illustrates an example electromagnet configuration of an embodiment of this invention.
Figure 3:
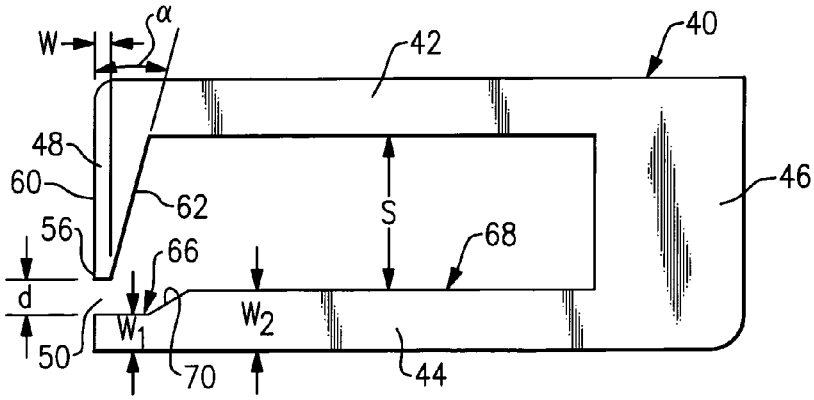
FIG. 3 shows selected features of the embodiment of FIG. 2.

Referring to FIGS. 2 and 3, an example embodiment of an electromagnet 30 is shown in a partially cross-sectional, elevational view as seen from the top, for example, in FIG. 1. The illustrated electromagnet 30 includes a core 40 made from an appropriate ferromagnetic material. Those skilled in the art who have the benefit of this description will be able to select from appropriate metals, laminations or sintered powders for making the core 40 according to the needs of their particular situation.

The example core 40 includes a first side 42 and a second side 44 that are aligned at least partially generally parallel to each other. A third side 46 and a fourth side 48 are aligned at least partially generally parallel to each other. The third side 46 and fourth side 48 are also generally perpendicular to the first side 42 and the second side 44. In this example, each side 42, 44, 46 and 48 corresponds to a pole of the electromagnet.

Each of the first side 42, second side 44 and third side 46 are uninterrupted (e.g., comprises a solid, continuous surface across the side) as can be appreciated from the drawing. The fourth side 48 in this example includes a gap 50. In this example, the gap 50 extends along the entire height of the fourth side 48.

Providing a fourth side 48 on the core instead of providing a U-shape for the core and leaving a gap 50 that is smaller than a spacing between the first side 42 and the second side 44 concentrates the magnetic flux schematically shown at 52 and the associated magnetic attractive force of the electromagnet 30 near the gap 50. Only a portion of the magnetic flux distribution is schematically shown at 52 in FIG. 2.

By strategically placing the gap 50 relative to the vane 32, the disclosed example allows for concentrating the attractive magnetic force used to couple the electromagnet 30 to the vane 32, which facilitates coupling the elevator doors for movement together.

Although the illustrated example includes generally straight sides and a generally rectangular configuration, other configurations are possible that still include first and second sides arranged at least partially generally parallel to each other, third and fourth sides arranged at least partially generally parallel to each other and a gap in at least one of the sides. In other words, a core with a partially circular or irregularly shaped configuration may still have a plurality of sides and a gap that achieves the benefits of the illustrated example. One example includes two sides that are generally arcuate and aligned as mirror images of each other such that tangents along corresponding portions of the sides are generally parallel. It is not necessary in all example uses of an electromagnet designed according to an embodiment of this invention to have a generally rectangular core configuration as illustrated.

The illustrated example includes dimensional relationships between portions of the electromagnet 30 that have been designed to optimize the attractive force realizable within constraints placed on the electromagnet by the nature of the elevator door assembly and applicable codes. As can best be appreciated from FIG. 3, interior surfaces on the first side 42 and the second side 44 are spaced apart a distance s, which provides a spacing for receiving at least a portion of a coil 54. Energizing the coil 54 in a known manner results in generating the magnetic field used for coupling the electromagnet 30 to the vane 32, for example. In this example, the gap 50 has a dimension d. The size of the dimension d is less than the spacing s. The fourth side 48 in this example has a nominal width w on a portion 56 adjacent the gap 50. The second side 44, which is adjacent to the gap 50 in this example, has a nominal width $w_1$ along a portion 66 adjacent to the gap 50. The second side 44 also has a larger width $w_2$ along a portion 68 that is further from the gap 50 compared to the portion 66.

The configuration of the fourth side 48 in this example optimizes the amount of attractive force realizable with the given gap configuration. In this example, the fourth side 48 has a first surface 60 that faces generally outward or toward the vane 32. An oppositely facing surface 62 faces toward an interior of the core 40. In this example, the surface 62 is oriented transverse to the first surface 60. An oblique angle $\alpha$ of the orientation of the surface 62 relative to the surface 60 in this example depends on other dimensions of the core 40.

In one example, the angle $\alpha$ (shown in FIG. 3) is approximately equal to the arctangent of the width of the second side 44 divided by the sum of the inside space s and the dimension d (e.g., $\alpha \approx \arctan(w_1/(s+d))$). In one example, the nominal width $w_1$ of the second side 44 is used for determining the angle $\alpha$. In another example, the width $w_2$ is used (e.g., $\alpha \approx \arctan(w_2/(s+d))$).

In this example, the nominal width w of the fourth side 48 at the portion 56 is selected to have a dimensional relationship to the dimension d of the gap 50. In one example, the nominal width w is selected to be less than or equal to approximately one-half d. As can be appreciated from the illustration, the width of the fourth side 48 increases in a generally linear fashion in a direction moving away from the gap 50.

The nominal width $w_1$ of the second side 44 in this example is in a range below $\frac{9}{10}$ $w_2$.

The illustrated example includes a ramped surface 70 along a portion of the first side 44 facing the interior of the core 40. In this example, the ramped surface 70 is oriented at an oblique angle relative to the gap 50. The oblique angle $\alpha$ in this example is different than the oblique angle at which the ramped surface 70 is oriented relative to the gap 50. Having angled surface as included in the illustrated example increases the attractive force realizable at the gap 50 compared to an arrangement where the interior surfaces of the core 50 are perpendicular to each other.

As best appreciated in FIG. 2, the illustrated example is thermally coupled with the door hanger 34 such that the door hanger 34 acts as a heat sink for the electromagnet 30. In this example, the third side 46 has an increased thickness compared to the other sides of the core 40. In this example, an aluminum block 72 is used for mounting the electromagnet 30 to the door hanger 34. The block 72 and the core 40 are held in place by one or more fasteners 74. The aluminum block 72 allows a spacing for a portion of the coil 54 to be received between the core 40 and the door hanger 34. An appropriate insulation or coating is provided on the coil 54 to electrically isolate the coil 54 from the door hanger 54. The coupling through the aluminum block 72 provides for thermal conduction of heat from the electromagnet 30 through the door hanger 34. This provides a significant advantage in that distributing the heat from the electromagnet 30 allows for the example arrangement to fit within temperature limitations placed on such components by elevator codes. One example code requires that the temperature not exceed 80° C. The example arrangement allows for meeting this requirement without introducing bulky components that would not fit within the space constraints dictated by other code requirements. The illustration in FIG. 2 shows how one example arrangement fits within the space constraints between an elevator door sill 76 and a hoistway door sill 78. The same example complies with heat limitation requirements and provides sufficient magnetic coupling for reliably moving the doors 24 and 26 in unison.

In one example, an electromagnet design like the example embodiment of FIG. 2 has an attractive force at a 1 mm air gap that is at least twice as strong and up to almost five times as strong as a U-shaped core that would fit within the space constraints. The same example has a goodness factor, which depends on a relationship between the attractive force and the power consumption, that is about five times better than a correspondingly sized electromagnet having a U-shaped core.

Figure 4:
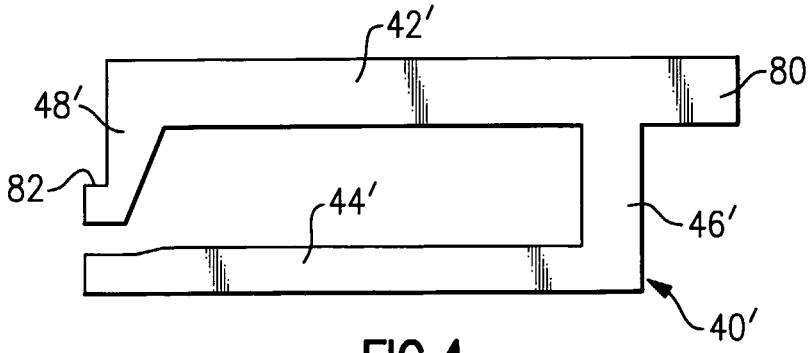
FIG. 4 shows another example embodiment.

FIG. 4 schematically shows another example arrangement where the electromagnet core 40' includes a flange 80 that is useful for mounting the electromagnet to a door hanger, for example. The example of FIG. 4 also includes a flange 82 near the gap 50 on the fourth side 48'. Incorporating the flange 82 allows for more specifically directing the magnetic flux in some examples.

The disclosed examples provides several advantages compared to known elevator door coupler arrangements. The disclosed examples reduce maintenance and callback frequency. The disclosed examples provide the same amount of functionality as conventional arrangements with much fewer parts. Some examples designed according to this invention have lower hardware costs that provide savings up to approximately 30% compared to conventional door couplers. Installation time onsite at the location of an elevator system can be significantly reduced because the locations of the door coupler components can be set in a manufacturing facility. The clearances or tolerances for arranging the vane 32 and the electromagnetic 30, for example, are not as stringent as required with mechanical coupler systems. This provides significant cost savings in labor and installation time.

The disclosed examples fit within the space constraints, provide sufficient coupling for reliable door operation and fit within the temperature restraints on elevator door components.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An electromagnet assembly, comprising:

a substantially rectangular magnet structure, configured to be operatively connected to a first elevator door, the substantially rectangular magnet structure comprising a first member, having a length and a width, the length being greater than the width, a first end, and a second end distal from the first end, a second member, having a length and a width, the length being greater than the width, a first end, and a second end distal from the first end, a third member, having a length and a width, the length being greater than the width, a first end, and a second end distal from the first end, and a fourth member, having a length and a width, the length being greater than the width, a first end, and a second end distal from the first end, wherein the second end of the first member is joined to the first end of the second member, wherein the second end of the second member is joined to the first end of the third member, wherein the second end of the third member is joined to the first end of the fourth member, wherein the second end of the fourth member is proximate the first end of the first member, wherein the first member is substantially parallel to the third member, wherein the second member is substantially parallel to the fourth member, and wherein the second end of the fourth member does not contact the first end of the first member, and a gap is formed between the second end of the fourth member and the first end of the first member, the gap having a length that is less than the length of the first member, the length of the second member, the length of the third member, and the length of the fourth member;

the electromagnet assembly further comprising a vane configured to be operatively connected to a second elevator door, where the vane is further configured to be selectively coupled to the substantially rectangular magnet structure proximate the gap.

2. The assembly of claim 1, wherein the fourth member has a surface that is at an oblique angle relative to the gap, and the oblique angle is approximately equal to the arctangent of the width of one of the members that is adjacent the fourth member divided by the sum of the dimension and the spacing between the first and second members.

3. The assembly of claim 1, wherein the fourth member has a first surface and a second surface that is oriented relative to the first surface at an oblique angle;

the first member has a first, nominal width along a portion of the first member near the gap and a second, relatively larger width along another portion of the first member further from the gap; and at least one of the first width or the second width determines the oblique angle.

4. The assembly of claim 1, wherein the substantially rectangular magnet structure defines an outer periphery of the magnet structure.

5. The assembly of claim 1, wherein the gap length is less than one half of the length of the first member, the length of the second member, the length of the third member, and the length of the fourth member, respectively.

6. The assembly of claim 1, wherein a magnetic attractive force external to the magnet structure and associated with a magnetic field of the electromagnet is greatest near the gap.

7. An elevator door assembly, comprising:

an electromagnet associated with a first elevator door, the electromagnet comprising a core including four three-dimensional side pieces that collectively establish a generally rectangular periphery having four sides corresponding to the side pieces, a first one of the side pieces and a second one of the side pieces being generally parallel to each other, a third one of the side pieces and a fourth one of the side pieces being generally parallel to each other and generally perpendicular to the first and second side pieces, the third side piece having a length corresponding to a spacing between the first and second side pieces, the fourth side piece having a length that is less than the spacing between the first and second side pieces such that there is a gap between an end of the fourth side piece and the first side piece, the gap having a dimension that is smaller than the spacing between the first and second side pieces; and a vane associated with a second elevator door and positioned near the gap such that a magnetic coupling between the electromagnet and the vane facilitate the first and second elevator doors moving together.

8. The assembly of claim 7, including a door hanger associated with the first elevator door and wherein the core is adjacent the door hanger such that the door hanger absorbs heat from the electromagnet.

9. The assembly of claim 8, wherein at least one of the side pieces of the core receives a fastener for securing the core to the door hanger.

10. The assembly of claim 9, wherein the at least one of the side pieces includes an extension that receives the fastener.

11. The assembly of claim 7, wherein the fourth side piece has a surface that is at an oblique angle relative to the gap, and the oblique angle is approximately equal to the arctangent of the width of one of the side pieces that is adjacent the fourth side piece divided by the sum of the dimension and the spacing between the first and second side pieces.

12. The assembly of claim 7, wherein the first side piece has a length that is generally perpendicular to the length of the fourth side piece;

the fourth side piece has a width that is generally perpendicular to the length of the fourth side piece;

the width of the fourth side piece increases linearly such that a surface of the fourth side piece facing an interior of the core is at an oblique angle relative to the gap, the first side piece has a portion adjacent the gap and the first side piece includes a surface along at least some of the length of the first side piece facing the interior of the core that is at an oblique angle relative to the gap.

13. The assembly of claim 7, wherein the fourth side piece has a first surface and a second surface that is transverse to the first surface.

14. The assembly of claim 13, wherein the gap extends through the fourth side piece in a direction that is generally perpendicular to the first surface and transverse to the second surface.

15. The assembly of claim 13, wherein the second surface is oriented relative to the first surface at an oblique angle.

16. The assembly of claim 7, wherein the fourth side piece has a first surface and a second surface that is oriented relative to the first surface at an oblique angle;

the first side piece side has a first, nominal width along a portion of the first side piece near the gap and a second, relatively larger width along another portion of the first side piece further from the gap; and at least one of the first width or the second width determines the oblique angle.

17. The assembly of claim 16, wherein the first width is less than about 9/10 of the second width.

18. The assembly of claim 16, wherein the portion of the first side piece that is near the gap is immediately adjacent the gap such that a surface on the portion of the first side piece establishes one edge of the gap.

19. The assembly of claim 7, wherein the gap has a dimension, the fourth side piece has a nominal width along a portion adjacent the gap, and the nominal width is less than about one-half the dimension.

20. The assembly of claim 19, wherein the fourth side piece has another, relatively larger width along a portion further from the gap.

21. The assembly of claim 19, wherein the fourth side piece has a width that increases from the nominal width along the length of the fourth side piece.

22. The assembly of claim 7, wherein the first side piece includes a surface facing the interior of the core that is at an oblique angle relative to the gap, and the fourth side piece includes a surface facing the interior of the core that is at a second, different oblique angle relative to the gap.

23. The assembly of claim 7, wherein a magnetic attractive force external to the core and associated with a magnetic field of the electromagnet is greatest near the gap.

24. The assembly of claim 7, wherein the length of the fourth side piece is greater than one-half the spacing between the first and second side pieces; and the gap dimension is smaller than one-half the spacing between the first and second side pieces.

25. The assembly of claim 7, wherein the generally rectangular periphery defines an outer periphery of the core.

* * * * *